US006325675B1

(12) United States Patent
Harmeyer

(10) Patent No.: US 6,325,675 B1
(45) Date of Patent: Dec. 4, 2001

(54) ELECTRICAL-CONNECTOR INSULATING COVER HAVING A HINGED ACCESS COVER

(75) Inventor: Joseph C. Harmeyer, Cincinnati, OH (US)

(73) Assignee: Ilsco Corporation, Cincinnati, OH (US)

( * ) Notice: Subject to any disclaimer, the term of this patent is extended or adjusted under 35 U.S.C. 154(b) by 0 days.

(21) Appl. No.: 09/692,563

(22) Filed: Oct. 19, 2000

Related U.S. Application Data

(60) Provisional application No. 60/176,377, filed on Jan. 14, 2000.

(51) Int. Cl.[7] ..... H01R 9/22

(52) U.S. Cl. ..... 439/709; 439/722

(58) Field of Search ..... 439/709, 721, 439/722, 723, 724, 921, 727, 810, 811, 812, 813, 814, 135, 136, 142, 798; 174/138 F, 145

(56) References Cited

U.S. PATENT DOCUMENTS

| | | | |
|---|---|---|---|
| D. 246,647 | 12/1977 | Budd | D13/17 |
| D. 354,272 | 1/1995 | Reed | D13/156 |
| D. 354,273 | 1/1995 | Reed | D13/156 |
| D. 409,576 | 5/1999 | Wood et al. | D13/154 |
| 1,934,581 | 11/1933 | Bach | 174/145 |
| 2,456,259 | 12/1948 | Dorjee | 174/145 |
| 3,701,087 | 10/1972 | Bernard | 439/724 |
| 3,937,552 | 2/1976 | Parsons | 439/738 |
| 3,937,870 | 2/1976 | Bumpstead et al. | 220/21 X |
| 3,983,314 | 9/1976 | Filhaber | 174/138 F |
| 3,984,623 | 10/1976 | Worden | 174/138 F |
| 4,032,209 | 6/1977 | Rutkowski | 439/355 |
| 4,214,806 | 7/1980 | Kraft | 439/620 |
| 4,382,651 | 5/1983 | Klosin et al. | 439/359 |
| 4,513,169 | 4/1985 | McGrane | 439/810 |
| 4,547,627 | 10/1985 | McGrane | 174/138 F |
| 5,114,036 | 5/1992 | Liu | 220/307 |
| 5,804,770 * | 9/1998 | Tanaka | 174/138 F |
| 5,931,708 * | 8/1999 | Annas et al. | 439/798 |

* cited by examiner

*Primary Examiner*—Tulsidas Patel
(74) *Attorney, Agent, or Firm*—Wood, Herron & Evans, L.L.P.

(57) ABSTRACT

An insulating cover for an electrical connector has a core chamber, a first opening which communicates with the core chamber, and a second opening which communicates with the core chamber. The core chamber itself is constructed and arranged to house an electrical connector, and each of the first and second openings is constructed and arranged to allow an end portion of an electrical conductor to pass through the particular opening. The insulating cover further has a hinged access cover adjacent one of the first and second openings, with the hinged access cover constructed and arranged to hingedly cover, and provide access to, the adjacent first or second opening.

21 Claims, 6 Drawing Sheets

ELECTRICAL-CONNECTOR INSULATING COVER HAVING A HINGED ACCESS COVER

CROSS-REFERENCE TO RELATED APPLICATION

This application claims the benefit of the filing date of Provisional U.S. Patent Application No. 60/176,377 entitled "Connector-Bar Insulated Cover Having Hinged Access Gates" filed on Jan. 14, 2000. The entire disclosure of application Ser. No. 60/176,377 is hereby incorporated by reference.

BACKGROUND OF THE INVENTION

1. Field of Invention

This invention is directed to electrical connectors, and more particularly to insulated electrical connectors and to insulating covers for use with electrical connectors.

2. Description of the Related Art

Insulated electrical connectors are used in many different environments, including, for example, control panels, switchgear, HVAC, motor controls, elevator systems, refrigeration systems, pull boxes, wireway, and any other commercial construction and industrial applications requiring multiple taps or splices.

Conventional insulated electrical connectors include an electrical connector encased within an opaque plastic housing which conforms to the shape of the particular connector. Such insulated connectors further include removable caps and plugs for covering the connector wire ports and screw ports which are not being used. These conventional insulated connectors typically are formed by inserting protective pins into the screw ports and wire ports and dipping the resulting connector assembly into a molten insulating material, such as an opaque plastic material. The assembly then is removed from the molten material, at which point the insulating material is allowed to cure or otherwise harden about the electrical connector. At this point, a hot knife or other cutting device is used to remove unwanted insulating material and expose the various pins so that the pins may be removed, thereby providing access to the various screw ports and wire ports. In an additional step, insulating plugs and caps are made and releasably positioned in the various screw ports and wire ports. This method has been used for years to make a wide range of types and sizes of insulated electrical connectors. However, the resulting insulated connectors have several drawbacks. For example, production costs associated with the "dip and hot knife" method are relatively high. Also, because removable caps and plugs are used, these separate pieces are easy to lose during the installation process. Once a plug or cap is lost, some installers attempt to cover resulting openings with tape, a solution which is awkward at best. In addition, because the insulating material is opaque, it is difficult, if not impossible, to see the various wire ports and screw ports during installation, making the installing process more time consuming and therefore more costly.

More recently, the electrical connector industry has seen the introduction of a different type of insulating cover for use with large-scale electrical connectors, i.e., connectors having wire ranges of: 2/0–14; 4/0–6; 350 MCM-6; and 600 MCM-4. In further detail, this type of insulated electrical connector includes a transparent flexible insulating cover made of a plastisol, with the cover being fully open at one end. Because the cover is relatively large, it is able to be fabricated with one end which is fully open and which may be covered by a separate removable large end plate. An elongated electrical connector bar, including screws mounted in the screw ports, is telescopically slid into the insulating cover, at which point a separate insulating end plate made of lexan or another transparent insulating material is releasably secured onto the open end. The insulating cover further includes a series of "star cuts" in alignment with the various screw ports and wire ports, thereby providing access to these ports while alleviating the need for caps and plugs. A wire or torquing tool then may be inserted through a particular star cut and into a wire port or onto a screw head, as appropriate, for securing wires to the insulated connector.

While this more-recently developed type of insulated electrical connector has been extremely well-received in the industry, the cover is a large-scale cover having two separate component parts, the flexible housing and the end plate. Accordingly, if a particular application calls for a small-scale connector (e.g., wire ranges such as 4–14), a conventional "dipped and hot-knifed" connector, with its associated problems, typically is used. Therefore, it would be beneficial to have a small-scale insulating cover offering the benefits of a transparent, flexible, insulating cover. It also would be beneficial for such a cover to fully encapsulate an electrical connector without the need for separate pieces, such as caps, plugs, or end plates.

SUMMARY OF THE INVENTION

The present invention overcomes the above-mentioned limitations by providing a one-piece transparent flexible insulating cover which fully surrounds and insulates an electrical connector without the need for separate plugs, caps, or end plates.

In one aspect, the cover has openings which correspond and communicate with the wire port(s) and screw port(s) of an electrical connector, as well as a hinged access cover adjacent at least one of the openings. The hinged access cover pivots about a hinge, from a closed position to any of a number of different open positions, thereby alternatively covering, and providing access to, the adjacent opening.

In this fashion, the invention provides a one-piece transparent flexible insulating cover which may be formed in a wide range of types and sizes, thereby fully insulating not only small-scale electrical connectors, but also large-scale electrical connectors, all without the need for separate plugs, caps, or end plates. Also, because of the one-piece design, the manufacturing costs associated with the present invention are relatively low, thereby providing a product which is not only user-friendly, but also economical.

In another aspect of the invention, the insulating cover has a core chamber for housing an electrical connector, a first opening which communicates with the core chamber, and a second opening which communicates with the core chamber. Each of the first and second openings is constructed and arranged to allow an end portion of a wire or other electrical conductor to pass through the particular opening. As used herein, the term "electrical conductor" refers to any conductive wire, bundle of wires, or cable suitable for use with an electrical connector. The insulating cover has a hinged access cover adjacent one of the first and second openings, with the hinged access cover constructed and arranged to hingedly cover, and provide access to, the adjacent first or second opening.

The hinged access cover may include a hinge having a first end and a second end, with the hinged access cover further including a first side edge adjacent the first end, a second side edge adjacent the second end, and an end opposite the hinge. If desired, the end opposite the hinge may have an end edge. In one aspect of the invention, the length of the end edge is substantially similar to the length of the hinge. In another aspect, the length of the first side edge is substantially similar to the length of the second side edge. In another aspect of the invention, the hinge may be a living hinge. And because the living hinge may be formed from the insulating cover itself, without the use of additional components, the living-hinge feature assists in reducing overall manufacturing costs.

In a further aspect of the invention, the hinged access cover has a first section adjacent the hinge and a second section adjacent the end opposite the hinge, with an interior angle of less than 180° existing between the first and second sections. In another aspect, the hinged access cover has a third section positioned between the first and second sections, with a first interior angle of less than 180° existing between the first and third sections, and a second interior angle of less than 180° existing between the second and third sections. If desired, the first interior angle and the second interior angle independently may have a value in the range of 100° to 150°, or a value in the range of from 120° to 135°.

Regardless of whether the hinged access cover includes two, three, or more adjacent sections, with each pair of adjacent sections having an interior angle of less than 180°, the junction line where one section meets an adjacent section is capable of functioning as an additional hinge, advantageously a living hinge. This characteristic of multiple hinges on the same access cover allows a user to rotate the hinged access cover up and away from the particular opening with ease, thereby providing ready access to the particular opening. In addition, because of the multiple hinges, if an electrical conductor, torquing tool, or the like is removed from the opening, the hinged access cover will tend to return to a closed position, thereby covering the particular opening. The multiple-hinge feature further enables the hinged access cover to be "range finding". "Range finding" means that, regardless of the wire range (i.e., cross-sectional diameter of the particular electrical conductor), the end of the hinged access cover opposite the hinge will tend to return to, and contact, the exterior surface of the electrical conductor positioned in the particular opening which leads to, and communicates with, the corresponding wire port in the electrical connector, regardless of the wire range of the electrical conductor being used. This feature is particularly beneficial in that, not only will the hinged access cover seek a closed position when there is no electrical conductor, tool, or the like inserted through the particular opening, but also, the hinged access cover will tend to move toward a closed position until the end opposite the hinge comes in contact with the particular item inserted in the opening. In this fashion, the hinged access cover continues to assist in insulating the electrical connecter and protecting a user, whether or not an item is inserted through the particular opening.

In a further aspect of the invention, the insulating cover includes a first chamber which projects outwardly from the core chamber, with the first chamber having at least one of the first and second openings which communicate with the core chamber. In addition, if desired, the first chamber may include one or more hinged access covers.

In another aspect, the insulating cover includes a second chamber projecting outwardly from the core chamber with the second chamber having an opening which communicates with the core chamber. If desired, the second chamber may be peripherally (e.g., circumferentially) spaced approximately 90° from the first chamber. Also, the opening or openings of the second chamber may be constructed and arranged to receive a tool for tightening and loosening (e.g., a torquing tool) a securing member (e.g., a screw) in a securing port (e.g., a screw port) of an electrical connector when an electrical connector is positioned within the core chamber of the insulating cover.

In yet another aspect of the invention, the insulating cover includes a third chamber projecting outwardly from the core chamber, with the third chamber having one or more openings which communicate with the core chamber. If desired, the third chamber may be peripherally spaced approximately 180° from the first chamber. Also, the opening or openings of the third chamber may be constructed and arranged to allow an end portion of an electrical conductor to pass through each such opening.

In a further aspect, the core chamber is constructed and arranged to house an electrical connector having two conductor ports aligned in a row. In this aspect, the first chamber has an outer wall, as well as both of the first and second openings, with the first and second openings being aligned in a row. Moreover, these first and second openings may be aligned so that they are in registry with the two conductor ports of the electrical connector when the electrical connector is positioned within the insulating cover. The first chamber also has an insulating divider wall positioned between the first and second openings and extending from the outer wall to the core chamber. The insulating divider wall offers several benefits. For example, it creates separate "stalls" or "sub-chambers" within the first chamber, thereby making it even easier for a user to insert a first electrical connecter through the first opening and into a corresponding conductor port. The insulating divider wall further enhances the stability of the first chamber, and therefore, of the insulating cover.

In another aspect, the insulating cover includes a core chamber and a second chamber projecting outwardly from the core chamber, with the core chamber being constructed and arranged to house an electrical connector having at least two securing ports aligned in a row. In addition, the second chamber, itself, has an outer wall and two or more openings aligned in a row and communicating with the core chamber, with the two or more openings being in alignment with the securing ports of an electrical connector when an electrical connector is housed within the insulating cover.

In this particular aspect, the second chamber may further include an insulating divider wall positioned between each such opening and extending from the outer wall to the core chamber. As with the insulating divider wall of the first chamber, this particular divider wall provides similar benefits, for example, the ability to stiffen, and thereby further enhance the structural integrity of, the second chamber. Also, if an electrical connector and securing members (e.g., threaded screws) are encapsulated within the insulating cover, the insulating divider wall creates a separate "stall" or "sub-chamber" for each securing member. This is particularly beneficial in that, if, for example, a screw is backed all the way out of its corresponding screw port, the screw will remain in its stall, and typically in a generally upright position, thereby making it easy for a user to reinstall the screw into the screw port by passing the working end of a screwdriver or other similar tool through the particular opening in the second chamber and re-threading the screw into the screw port.

In a further aspect of the invention, and as an alternative to the insulating divider wall discussed immediately above, the second chamber outer wall may have an interior surface which includes a projection, with the projection being constructed and arranged so as to form a separate stall or sub-chamber on either side of the projection. In this fashion, the projection assists in preventing a securing member associated with one securing port from falling or sliding over into an adjacent stall.

In another aspect of the invention, the hinged access cover may have a peripheral edge which is substantially circular. Also, in a further aspect, a second hinged access cover may be positioned on the first hinged access cover. In such a situation, the second, or outermost, hinged access cover typically will have a diameter smaller than that of the hinged access cover upon which it sits. In this fashion, a user may choose between the inner or outer hinged access cover depending, for example, on the cross-sectional diameter of the electrical conductor being used.

Additional benefits and advantages of the present invention will be apparent from the accompanying drawings and detailed description of the drawings.

BRIEF DESCRIPTION OF THE DRAWINGS

The accompanying drawings, which are incorporated in and constitute a part of this specification, illustrate versions of the invention, and, together with the general description of the invention given above, and the detailed description of the drawings given below, assist in explaining the principles of the invention.

DETAILED DESCRIPTION OF THE DRAWINGS

Figure 1:
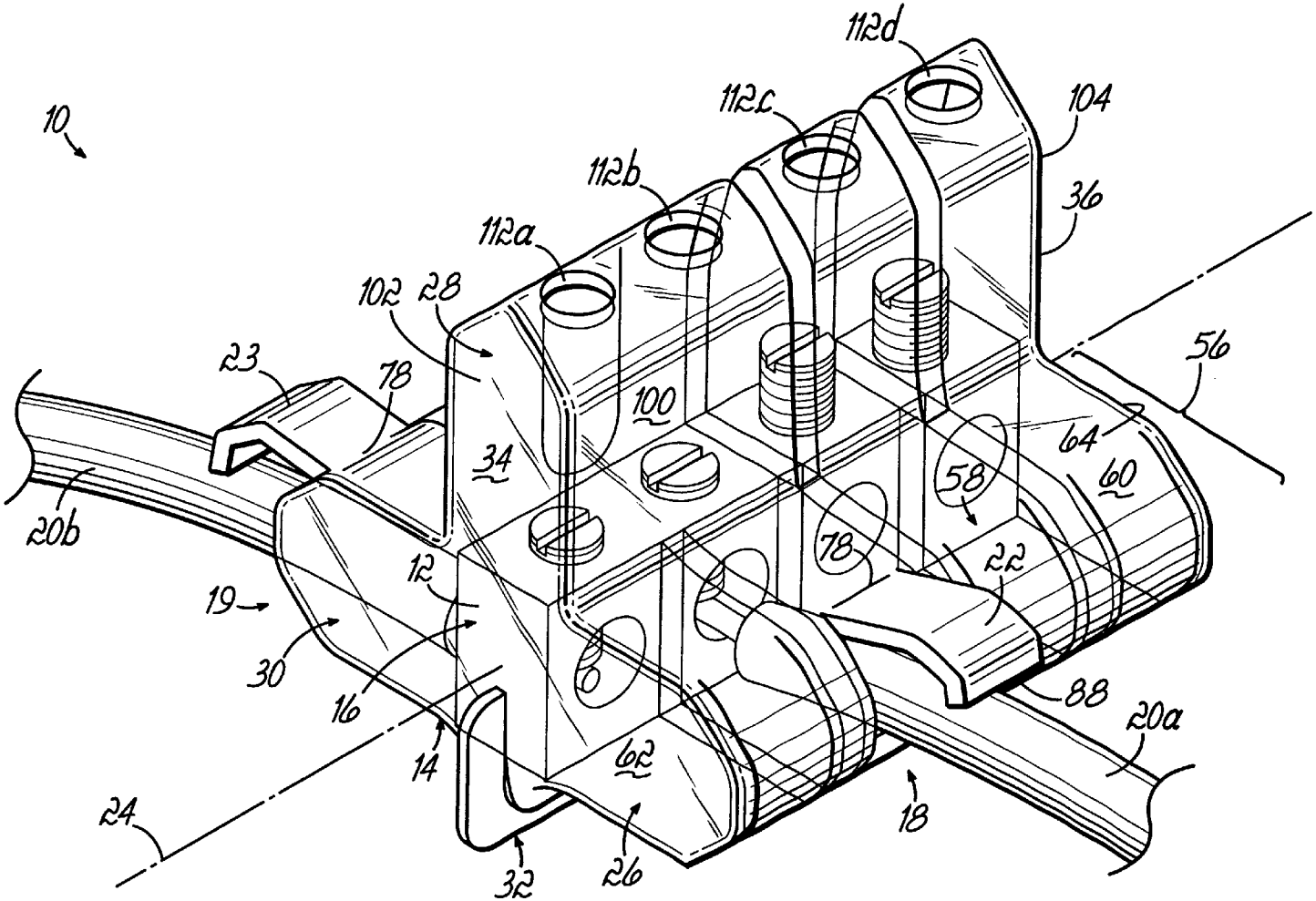
FIG. 1 is a perspective view of one version of the insulated electrical connector of the present invention.

With reference to FIGS. 1–9, an insulated electrical connector 10 having an electrical connector bar 12 housed within an insulating cover 14, according to the principles of the invention, is shown.

The insulating cover 14 has a core chamber 16, a first opening 18 which communicates with the core chamber, and a second opening 19 which communicates with the core chamber. The core chamber is constructed and arranged to house the electrical connector 12, and each of the first and second openings is constructed and arranged to allow an end portion of an electrical conductor 20*a*, 20*b* to pass through the particular opening. The insulating cover further has a hinged access cover 22 or 23 adjacent one of the first and second openings 18, 19, with the hinged access cover constructed and arranged to hingedly cover, and provide access to, the adjacent first or second opening. The particular insulating cover 14 shown happens to include a hinged access cover 22, 23 adjacent both of the openings 18, 19.

In further detail, the insulating cover 14 has a longitudinal axis 24, first, second, and third elongated projecting chambers 26, 28, 30, a back wall section 32, and first and second end walls 34, 36. The first chamber 26 projects outward perpendicular to the longitudinal axis 24, the second chamber 28 is peripherally (i.e., circumferentially) spaced about 90° from the first chamber and also projects outward perpendicular to the longitudinal axis 24, and the third chamber 30 is peripherally spaced about 180° from the first chamber and also projects outward perpendicular to the longitudinal axis 24 of the insulating cover.

The insulating cover 14 will be described in greater detail below, following a brief description of the electrical connector bar 12. As best shown in FIG. 3, the electrical connector 12 is an elongated electrical connector bar having a longitudinal axis 37 which is substantially parallel with the longitudinal axis 24 (FIG. 1) of the insulating cover 14, a substantially uniform rectangular cross-section, first, second, third, and fourth elongated side walls 38, 40, 42, 44, and first and second end walls 46, 48. The connector has a series of four wire ports 50*a*, 50*b*, 50*c*, and 50*d* aligned in a row, which extend from the first side wall 38, through the connector, to the third side wall 42, in an orientation which is generally perpendicular to the connector longitudinal axis 37. The connector bar also has a series of four securing ports and corresponding securing members which, as shown, are threaded screw ports 52*a*, 52*b*, 52*c*, and 52*d* and correspondingly threaded screws 54*a*, 54*b*, 54*c*, and 54*d*. The screw ports are aligned in a row on the second side wall, with each of the four screw ports communicating at an approximately 90° angle with a corresponding wire port. In this fashion, when a wire or other electrical conductor is inserted at least part-way into one of the wire ports, the corresponding screw may be threaded into the screw port, thereby biasing the wire against a portion of the circumferential side wall of the wire port, and releasably securing the wire in place (FIG. 2).

Figure 2:
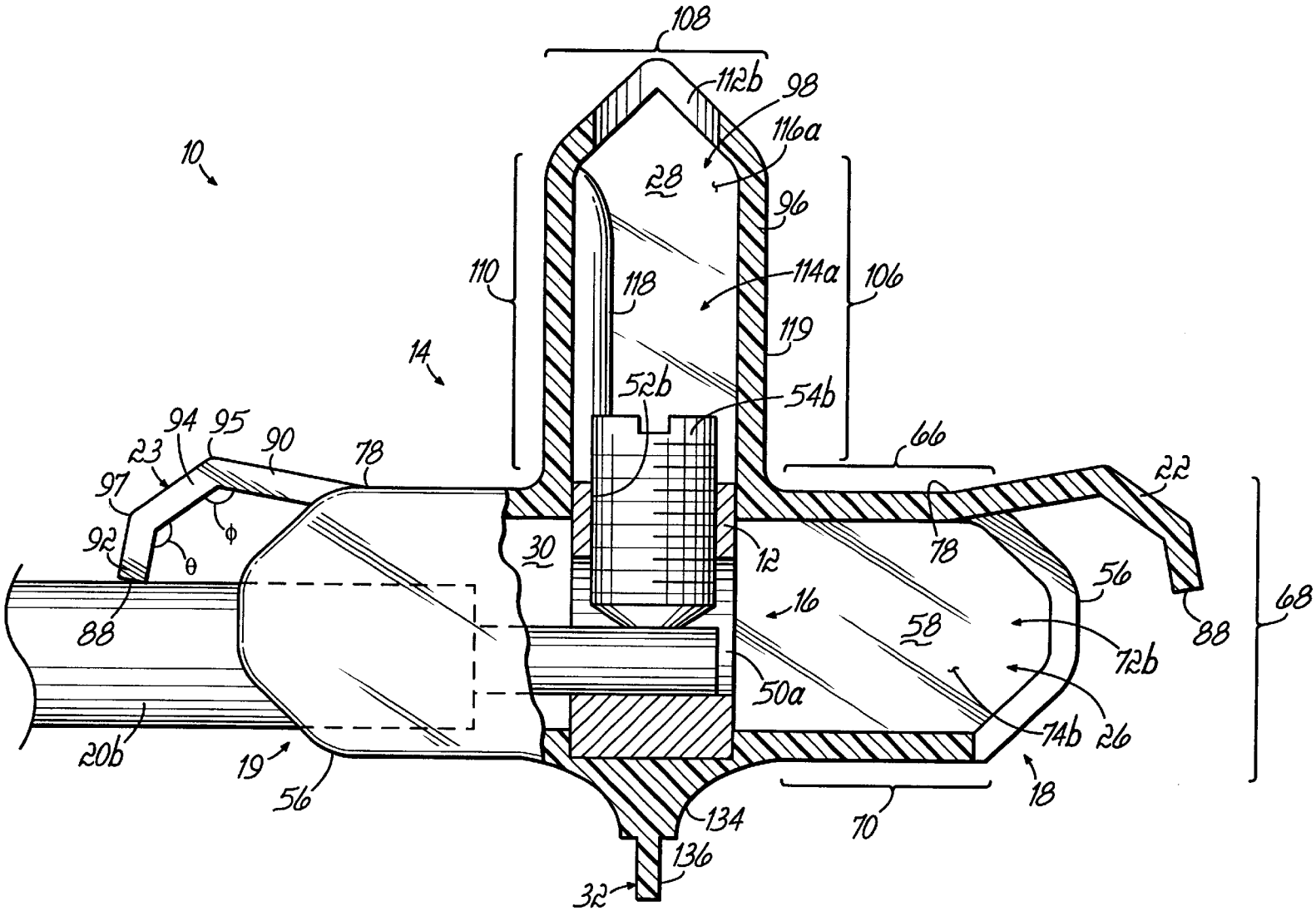
FIG. 2 is a partially broken away, cross-sectional view of the insulated connector substantially as shown in FIG. 1.
Figure 3:
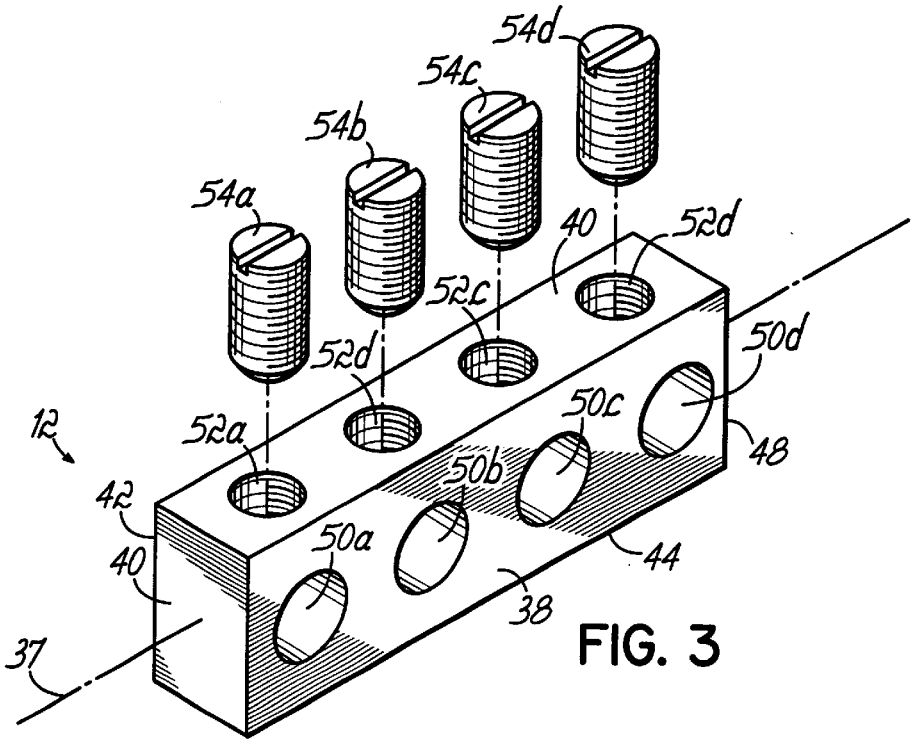
FIG. 3 is a perspective view of an electrical connector bar.
Figure 6:
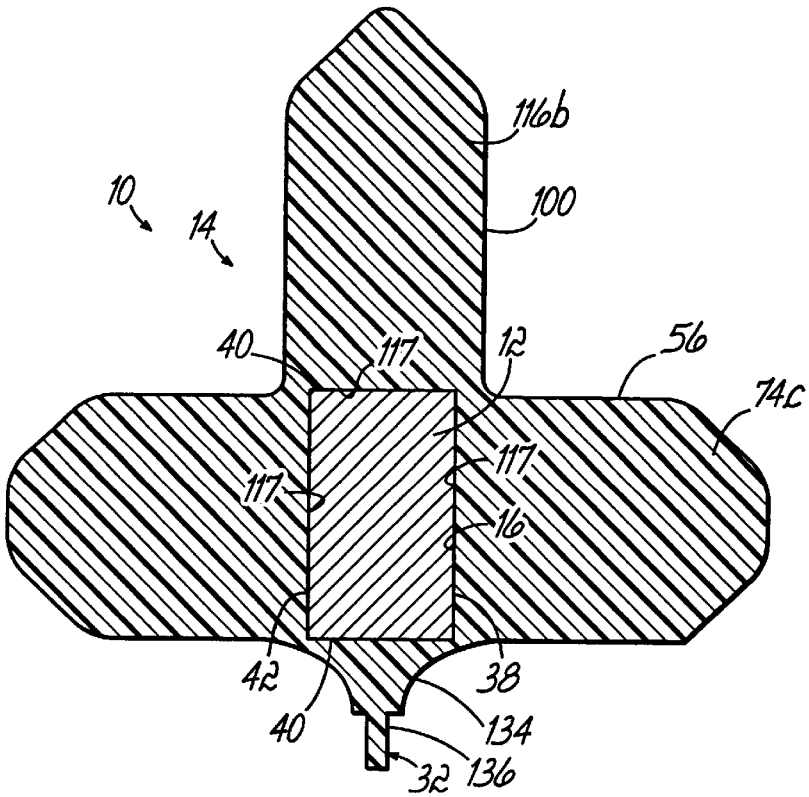
FIG. 6 is a cross-sectional view taken along line 6—6 of FIG. 4.

The connector bar 12 is completely encapsulated in the insulating cover 14, with the insulating cover having a cross-sectional shape much like an inverted "T" (See, for example, FIGS. 2 and 6). The core chamber 16 of the insulating cover is defined generally by the intersection of the inverted "T", that is, the elongated space where the first and third elongated projecting chambers 26, 30 meet the second elongated projecting chamber 28.

In further detail, the first chamber 26 of the insulating cover 14 includes an outer wall 56 and an inner cavity 58 defined by the outer wall, with the outer wall including an elongated side wall 60, a first end wall section 62, and a second end wall section 64. The elongated side wall 60 has a cross-sectional shape which approximates a "U" resting on its side (See FIGS. 1 and 2). The outer wall 56 has a first portion 66 connected to a second portion 68, and a third portion 70 connected to the second portion (See FIG. 2). The inner cavity 58 is divided into four distinct stalls 72*a*, 72*b*, 72*c*, and 72*d* by three insulating divider walls 74*a*, 74*b*, and 74*c* positioned generally equidistant from each other along the elongated length of the first chamber 26 (See FIG. 5).

The first chamber 26 further includes a series of four openings 18*a*, 18*b*, 18*c*, and 18*d* aligned in a row (with each opening being covered by a hinged access cover 22 as discussed in detail below), with each opening being separated by one of the insulating divider walls 74*a*–74*c*. The openings are positioned along the second portion 68 of the outer wall 56 (See FIGS. 4 and 7). In addition, the outer wall 56 includes a series of four hinged access covers 22*a*, 22*b*, 22*c*, and 22*d* arranged in a row and positioned so as to cover a corresponding opening 18*a*–18*d* (FIGS. 4 and 7).

Figure 4:
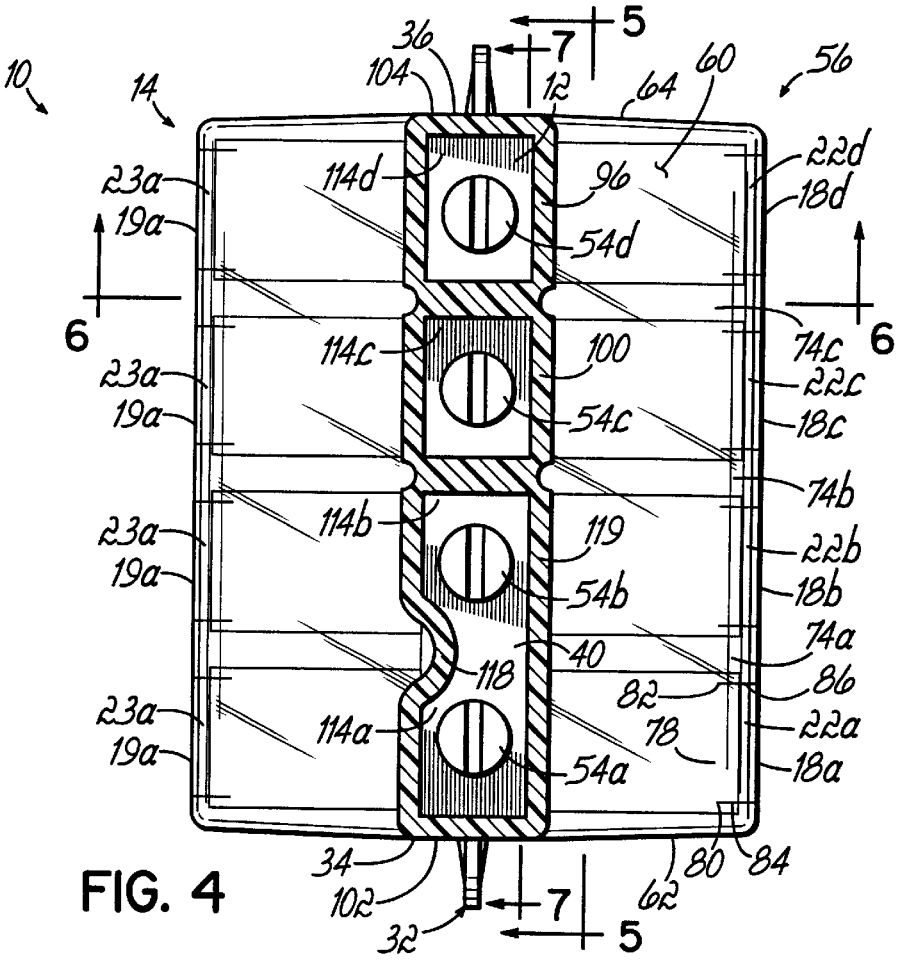
FIG. 4 is a partial cross-sectional view of the insulated connector substantially as shown in FIG. 1.
Figure 5:
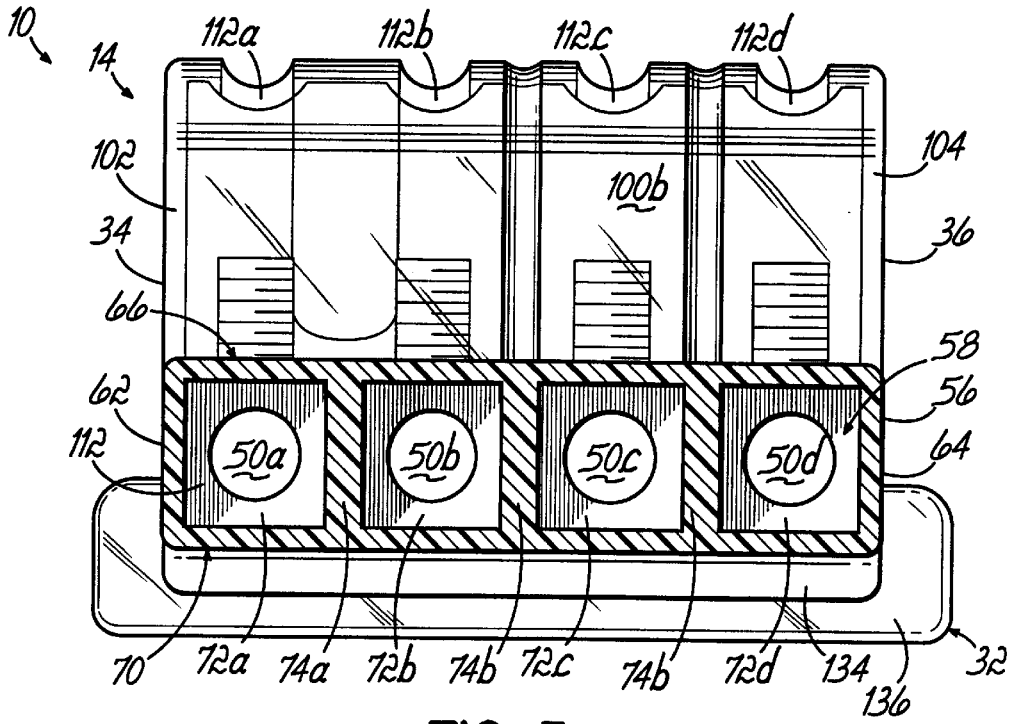
FIG. 5 is another partial cross-sectional view of the insulated connector taken along line 5—5 of FIG. 4.
Figure 7:
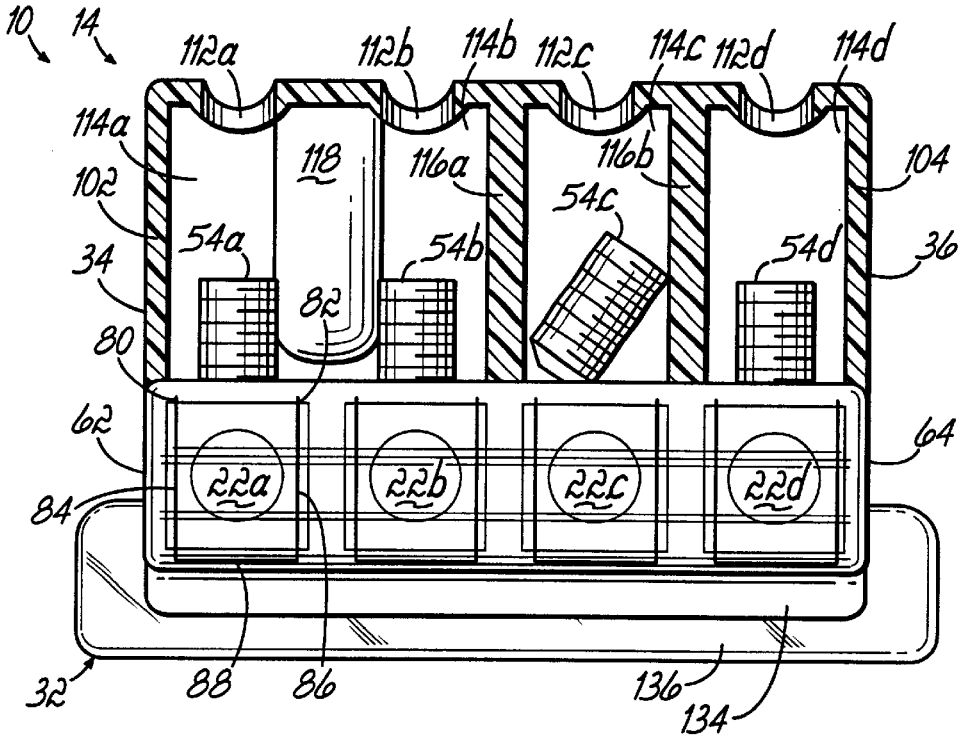
FIG. 7 is a further partial cross-sectional view of the insulated connector taken along line 7—7 of FIG. 4.

As shown in FIGS. 4 and 7, each hinged access cover 24*a*–24*d* includes a living hinge 78 having a first end 80 and a second end 82, a first side edge 84 adjacent the first end, a second side edge 86 adjacent the second end, and an end 88 opposite the living hinge. The length of the living hinge is substantially the same as the length of the end opposite the living hinge. In addition, the length of the first side edge is substantially the same as the length of the second side edge. As best shown in FIGS. 4, 5 and 7, the series of four openings 18*a*–18*d* and corresponding hinged access covers 22*a*–22*d* are in general alignment with the corresponding wire ports 50*a*–50*d* of the connector bar 12, thereby enabling a user to insert or remove a wire or other electrical conductor through any one of the openings and into the corresponding wire port with ease.

The third chamber 30 is virtually identical to the first chamber 26, with the third chamber being peripherally spaced approximately 180° from the first chamber. Given that the third chamber is substantially identical to the first chamber, one of ordinary skill in the art readily will appreciate from this detailed description and from the Figures that the third chamber contains elements similar to those which make up the first chamber. Accordingly, the third chamber will not be discussed in substantial detail. However, in order to describe additional important aspects of the hinged access covers 22, 23 of the invention, reference is made to the third chamber 30 as shown in FIG. 2, and in particular, to the hinged access cover 23 shown in that Figure. Note that cover 23 is identical to cover 22, except that it is associated with the third projecting chamber 30 as opposed to the first projecting chamber 26.

The features of the hinged access cover 23 shown in FIG. 2 and described in detail below are a part of each of the hinged access covers 22, 23 of the insulating cover 14 shown. In particular, the hinged access cover 23 includes a first section 90 adjacent the living hinge 78, a second section 92 adjacent the end 88 opposite the living hinge 78, and a third section 94 positioned between and connected to the first and second sections 90, 92. The third section 94 is connected to the first section 90 at a first junction 95, and to the second section 92 at a second junction 97. As with the first chamber 26, the third chamber 30 also has an elongated outer wall 56 having an interior surface, with the interior surface of the hinged access covers making up a part of the overall interior surface of the elongated outer wall. As best shown in FIG. 2, a first interior angle $\phi$ exists between the interior surfaces of the first and third sections 90, 94 of the hinged access cover 23 where these interior surfaces meet at the first junction 95, and a second interior angle $\theta$ exists between the interior surfaces of the second and third sections 92, 94 of the hinged access cover 23 where these interior surfaces meet at the second junction 97, with each of the first and second interior angles $\phi$,$\theta$ being approximately 135°. In this fashion, each of the first and second junctions 95, 97 is capable of functioning as an additional living hinge.

In further detail, when a user wants to expose an opening 18, 19 in the first or third chamber 26, 30, the user simply lifts the corresponding hinged access cover 22, 23 from a closed position to an open position. As the particular hinged access cover is opened, the elastic nature of the cover material enables the first and second interior angles to increase, thereby facilitating easy opening of the particular cover. Likewise, when a wire or other electrical conductor is passed through the corresponding opening into the corresponding wire port, the elastic nature, not only of the living hinge 78, but also of the junctions 95, 97 between the first, second, and third sections 90, 92, 94, assists the cover in moving naturally toward a partially-open position, in which the end 88 opposite the living hinge 78 rests on the wire (See, for example, third projection hinged access cover 23 in FIGS. 1 and 2). These junctions 95, 97, in combination with the living hinge 78, assist in returning the cover to a closed or partially-closed position once the wire or other electrical conductor is removed from the insulating cover.

The second projecting chamber 28 of the insulating cover 14 includes some features which are similar to those of the first and third projecting chambers 26, 30, and some features which are different. In further detail, the second chamber 28 has an outer wall 96 and an inner cavity 98 defined by the outer wall, with the outer wall including an elongated side wall 100, a first end wall section 102, and a second end wall section 104. As best seen in FIG. 2, the elongated side wall 100 has a cross-sectional shape which corresponds generally with an inverted "U". The outer wall 96 includes a first portion 106 connected to a second portion 108, and a third portion 110 connected to the second portion. The second portion 108 includes a series of four generally round openings 112*a*, 112*b*, 112*c*, and 112*d* (FIG. 5) spaced in a row, with each opening being in general co-axial alignment with a corresponding screw port 52*a*–52*d* of the electrical connector bar 12 contained within the insulating cover 14. Each opening 112*a*–112*d* is sized so as to prevent a corresponding screw 54*a*–54*d* contained within the second chamber 28 from falling out of the opening, thereby preventing the screws 54*a*–54*d* from becoming lost. At the same time, the openings are large enough that a user may insert a portion of a screwdriver or other torquing tool through an opening so that the user may tighten or loosen a corresponding screw 54 as needed. In addition, the second chamber is tall enough so that, if desired, a user may back any of the screws 54*a*–54*d* completely out of its corresponding screw port (FIG. 7).

As with the inner cavity 58 of the first and third chambers 26, 30, the inner cavity 98 of the second chamber 28 is divided into a series of four stalls 114*a*–114*d*, with each stall housing a particular screw 54 and providing access to an associated threaded screw port 52. (See, for example, FIGS. 4, 5 and 7). In further detail, the first and second stalls 114*a* and 114*b*, are formed by an arcuate, elongated curve 118 in the second projection elongated side wall 100, along the third portion 110 and an adjacent part of the second portion 108. This curve 118 is positioned between the first and second openings 112*a*, 112*b* of the second chamber 28, and extends far enough toward the first portion 106 of the elongated side wall 100 so as to prevent the first screw 54*a* from falling over into the space normally occupied by the second screw 54*b* and vice versa. In this fashion, the elongated curve 118 assists in forming the first stall 114*a* and the second stall 114*b* within the inner cavity 98 of the second chamber 28. The adjacent stalls 114*a* and 114*b* formed in this manner provide an added benefit to the insulating cover 14, in that the exterior surface of the first portion 106 of the elongated side wall 100 corresponding with the first and second stalls 114*a*, 114*b* is a substantially smooth, planar surface 119 (FIG. 1) which is sizeable enough to enable a manufacturer to put a product identification name, number, or other marking on this portion of the insulating cover 14.

The second chamber inner cavity 98 further includes first and second insulating divider walls 116*a* and 116*b* (FIGS. 4, 6 and 7), each of which extends completely across the inner cavity 98, transverse to the longitudinal axis 25 of the insulating cover 14. The first wall 116*a* is located between the second and third openings 112*b* and 112*c*, and assists in defining the second and third stalls 114*b* and 114*c*. The second wall 116*b* is located between the third and fourth openings 112*c* and 112*d*, and assists in defining the third and fourth stalls 114*c* and 114*d*.

As best seen in FIG. 2, an elongated back wall section 32 connects the third portions 70 of the outer walls 56 of the first and third chambers 26, 30.

The electrical connector bar 12 is held securely in place within the insulating cover 14 by several cover surfaces which bias against corresponding surfaces of the connector bar. For example, the inner ends 117 (See, for example FIG. 6) of the insulating divider walls 74, 116 of the first, second, and third chambers 26, 28, 30 bias against corresponding surfaces of the connector bar. Also, the interior surface of the inner end of the first portion 66, 106 of the first and second chambers biases against a corresponding surface of the connector bar; and the interior surface of the inner end of the second chamber third portion 110 and third chamber first portion 66 biases against a corresponding surface of the connector bar (See FIG. 2). In addition, the back wall section 32 includes a recessed channel 120 having a bottom wall and opposing side walls which bias against corresponding surfaces of the connector block (See FIG. 2). Also, the inner end of each of the first and second end wall sections 102, 104 of the second chamber 28 biases against the connector bar (See FIGS. 4, 5, and 7).

With regard to manufacture, the electrical connector bar 12 and screws 54 may be made using conventional manufacturing techniques, as will be apparent to those of ordinary skill in the art.

The insulating cover 14 shown in FIGS. 1–7 may be made using the following steps. If the insulating cover is made of a plastisol or other similar material with suitable insulating properties, a one-piece metallic pattern may be used in a dip-patterning process to form the insulating cover. The pattern may have an exterior surface with a shape which corresponds generally with the interior surface of the insulating cover 14 shown in FIGS. 1–7. In addition, the pattern may have a thin, elongated tongue (also referred to as a "tang") which projects outward from the back wall section of the pattern and which is in alignment with the longitudinal axis of the pattern. In this fashion, the portion of the pattern excluding the tongue may be dipped, or otherwise placed, into a container of plastisol, whereby plastisol surrounds and adheres to this portion of the pattern. If desired, several patterns may be placed into a rack, and the portion of each pattern excluding the tongue then may be placed into a container of plastisol. Typically, each pattern is heated to a temperature of about 600° F., and the plastisol in the container is at ambient or room temperature. After such a pattern has been dipped into the plastisol, the pattern (which now is encased in plastisol) is removed from the container of plastisol and cooled to about 150° F., thereby enabling the plastisol on the pattern to cure. At this point, the plastisol which is encasing the pattern is removed from the pattern, with the removed plastisol being what is referred to as a "part" (e.g., a partially-completed insulating cover). The part may be removed from the pattern using pressurized air, in a step typically referred to as "blowing" the part off of the pattern. At this point, because the tongue was not dipped in plastisol, the part has an elongated opening or slot which runs the length of the part, along the portion of the part which ultimately becomes the back wall section 32 of the insulating cover 14. While the part is still warm, an electrical connector bar 12, including screws 54 which are threaded at least partially into the screw ports 52, is positioned inside the part via this backside elongated opening or slot. As the part continues to cool, the part shrinks somewhat, which assists in securing the connector bar 12 within the part.

At this point, the elongated edges of the opening or slot positioned along the backside of the part are fused together using conventional radio-frequency ("RF") welding, as will be appreciated by those of ordinary skill in the art. Once the RF welding is complete, the fused plastisol or other material may be trimmed to form the back wall section 32 of the insulating cover 14. The back wall section 32 includes an elongated first portion 134 which tapers to an elongated second portion 136 which sometimes is referred to as a "keel" (FIG. 6). As will be seen from the discussion below, the elongated first and second portions 134, 136 may be useful features in making the various openings and hinged access covers of the insulating cover 14.

At this point, the various openings and hinged access covers may be made using an automated cutting machine which is controlled by a conventional programmable logic controller ("PLC"). The cutting machine includes an indexing (i.e., rotating) round turntable which is rotatably mounted on a support table, with the support table having four stations spaced equidistantly (90° apart) from each other. The turntable includes a mounting fixture for releasably securing an insulated connecter to the turntable, and the turntable rotates in a clockwise direction, thereby moving a connector from station to station until the various openings and hinged access covers have been formed in the connector.

Station one is the station for loading and unloading a connector from the cutting machine, and the mounting fixture starts and ends its four-station rotation here. An operator positions an uncut connector (i.e., an electrical connector bar 12 encased within an insulating cover which has been RF welded along its back wall section, but which has not yet had the various openings and hinged access covers formed in it) on the mounting fixture in an inverted position, with the second projecting chamber oriented downward in a recess, or well, of the fixture, and the back wall section oriented upward away from the turntable surface.

At this point, the cutting machine, including the air supply used to drive the various cutting assemblies, is turned on, and the cycle-start buttons are pressed to activate the automated cutting process.

The turntable rotates clockwise to station two, where a first air-driven cutting assembly is mounted to the support table adjacent the turntable. The cutting assembly includes a hold-down clamp and a cutting device. The hold-down clamp has a flat bar with a slot which comes down from above the turntable and straddles the back wall section of the connector, thereby securely and releasably holding the connector in the mounting fixture. The cutting device is mounted to a slide plate which moves horizontally toward the connector. The cutting device includes several circularly-shaped cutting blades, with a portion of each cutting blade piercing into, and cutting, a piece of plastisol from the second portion 108 of the second projection chamber elongated sidewall 100. Once the cuts have been made, the slide plate moves horizontally away from the connector, with the connector now having the second projecting chamber openings 112, and the hold-down clamp moves up and away from the connector.

At this point, the turntable rotates clockwise to station three, where a second air-driven cutting assembly is mounted to the support table adjacent the turntable. This cutting assembly includes a pair of parallel hold-down rollers and two horizontally-aligned opposing knife blades. In operation, the assembly is lowered down onto the inverted connector, at one end of the connector, where it begins to move along the length of the connector. In further detail, the hold-down rollers straddle the back wall section and roll along the corresponding third portions of the outer walls of the first and third projecting chambers 26, 30 of the connector. As the rollers move along the length of the connector, the two horizontally-aligned, opposing knife blades pierce into, cut, and withdraw from the insulating cover at predetermined points, thereby forming what will become the free ends of the hinged access covers, that is, the ends opposite the first living hinges of the access covers. Once this parallel series of cuts is made, the second air-driven cutting assembly moves up and away from the connector.

Next, the turntable rotates clockwise to station four, where a third air-driven cutting assembly is mounted to the support table adjacent the turntable. This cutting assembly includes a hold-down clamp and two opposing knife units. The hold-down clamp has a flat bar with a slot which comes down from above the turntable and straddles the back wall section of the connector. Each opposing knife unit has several pairs of knife blades, with each blade being oriented in the unit so that it forms a vertical cut when it is driven into and through the insulating cover. In operation, the hold-down clamp securely holds the connector in the mounting fixture while the opposing knife units move toward the corresponding sides of the connector, thereby forming the pairs of vertical cuts which serve as the first and second side edges of each of the hinged access covers. Once the cuts are made, the third air-driven cutting assembly moves up and away from the connector.

At this point, the turntable rotates clockwise a quarter turn, thereby returning the now-completed connector to station one. The operator pushes an eject button which operates an air cylinder mounted beneath the mounting fixture and turntable, which exerts an upward pressure on the completed connector, thereby assisting the operator in removing the connector from the fixture. Now the cutting process is complete, and the cutting machine is ready to receive another uncut connector.

In use, and as will be appreciated by those of ordinary skill in the art, the insulated electrical connector may be used in any of a number of different applications. For example, the connector may be used in control panels, switchgear, HVAC, motor controls, elevator systems, refrigeration systems, pull boxes, wireway, and any other commercial construction and industrial applications requiring multiple taps or splices.

Although FIGS. 1–7 illustrate one version of the invention, one of ordinary skill will appreciate that the invention extends far beyond this version, as seen, for example, in the summary of the invention presented above and in the claims presented below. By way of example, just a few of the many variations which fall within the scope of the invention are illustrated in FIGS. 8A, 8B, 9A, and 9B. In further detail, each of these Figures illustrates a different version of a projecting chamber 122*a*, 122*b*, 124*a*, 124*b* in which the projecting chamber is intended to receive a single electrical conductor, as opposed to a series of electrical conductors. In other words, each of the projecting chambers shown in FIGS. 8A–9B may be thought of not only as a projecting chamber, but also as an independent stall. Moreover, depending upon the particular electrical connector being used, one or more of these various styles of projecting chambers may be oriented side-by-side or in any other array, depending upon the particular connector bar being used.

Figure 8A:
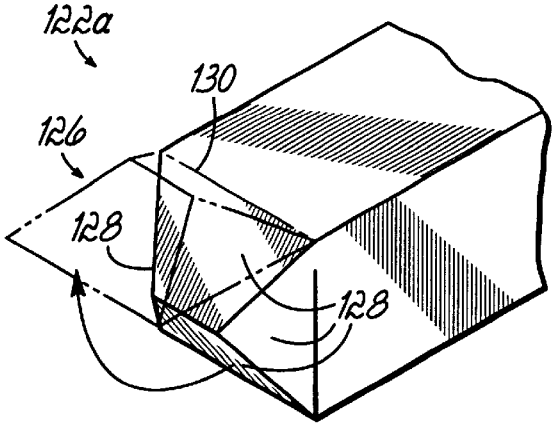
FIG. 8A is a perspective view of an alternate projecting chamber according to the principles of the invention.
Figure 8B:
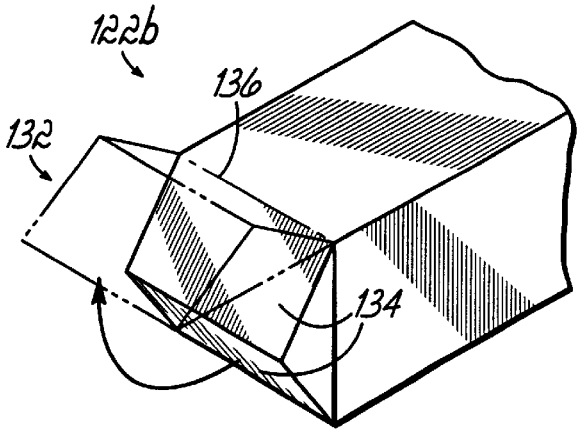
FIG. 8B is a perspective view of another alternate projecting chamber of the invention.
Figure 9A:
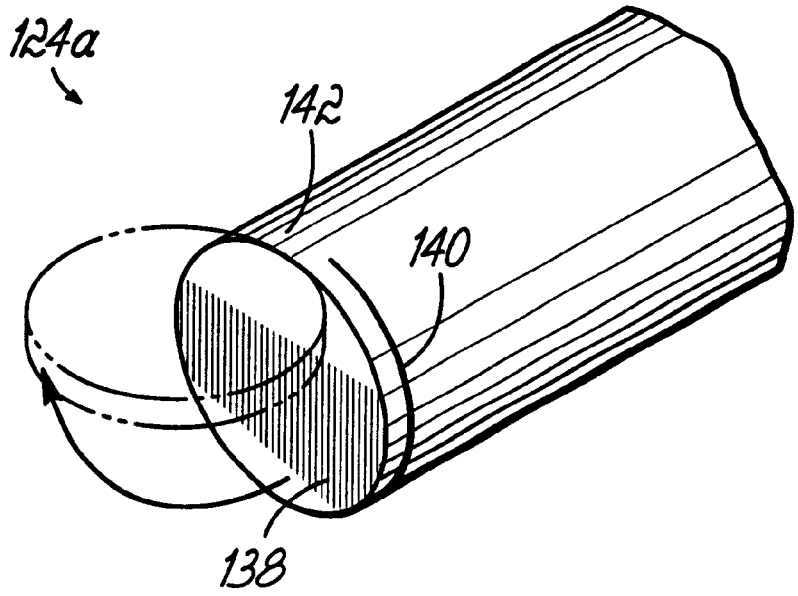
FIG. 9A is a perspective view of a further alternate projecting chamber of the invention.
Figure 9B:
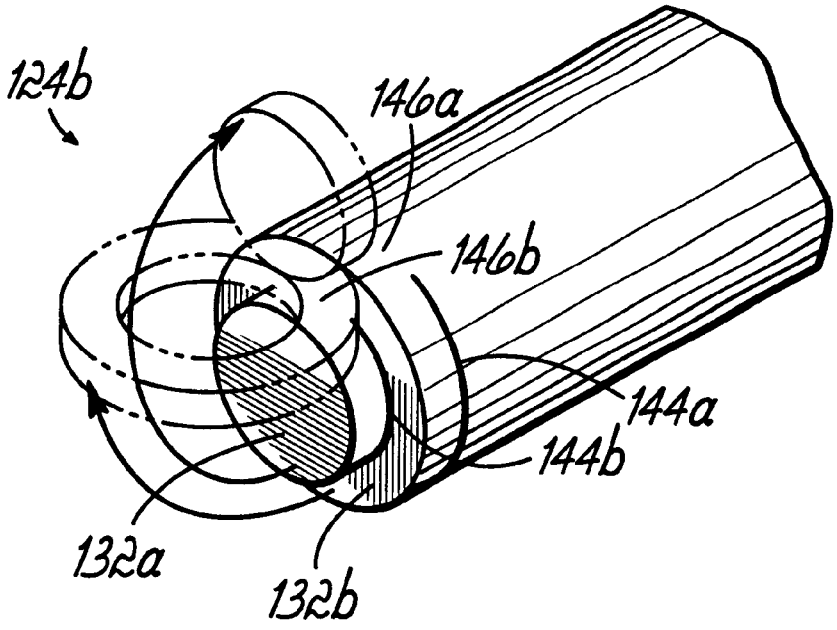
FIG. 9B is a perspective view of yet another alternate projecting chamber in accordance with the principles of the invention.

FIGS. 8A–9B also illustrate a few of the many possible forms which a hinged access cover may take, with each of the illustrated covers being shown in an open position (in phantom) and in a closed position. For example, FIG. 8A shows a hinged access cover 126 in which the cover has four surfaces 128, each of which tapers slightly. The cover 126 is slit on three sides and has a living hinge as at 130. FIG. 8B shows a hinged access cover 132 in which two of the four cover surfaces taper, as at 134. This cover 132 also is slit on three sides and has a living hinge as at 136. FIG. 9A illustrates a hinged access cover 138 having a circular peripheral edge and extending from a cylindrically shaped projecting chamber 124*a*. The cover 138 has a circumferential slit 140 and a living hinge 142. FIG. 9B shows a first hinged access cover 132*a* having a circular peripheral edge, as well as a second hinged access cover 132*b* having a circular peripheral edge and being positioned on the first cover, with the second cover having a cross-sectional diameter somewhat smaller than the first. The cover 132*a* has a circumferential slit 144*a* and a living hinge 146*a*, and the cover 132*b* has a circumferential slit 144*b* and a living hinge 146*b*. In this fashion, depending upon the gauge of the particular wire or other electrical conductor, a user has the option of employing either the first or second access cover 132*a*, 132*b*. Also, as in FIG. 9A, the cover of FIG. 9B extends from a cylindrically shaped projecting chamber 124*b*.

It should also be noted that, while the versions depicted in FIGS. 8A–9B include a projecting chamber, it is possible to use just the hinged access cover of each of these versions. For example, if desired, a manufacturer may substitute one or more of the hinged access covers of FIGS. 1–7 with one or more of the hinged access covers shown in FIGS. 8A–9B, while maintaining the other aspects of the first and third chambers shown in FIGS. 1–7.

While the present invention has been illustrated and described by presenting various versions of the invention, and while the illustrative versions have been described in considerable detail, it is not the intention of the inventor to restrict or in any way limit the scope of the appended claims to such detail. Additional advantages and modifications readily will appear to those of ordinary skill in the art upon a review of the summary, drawings, and detailed description. Accordingly, the invention, in its broader aspects, is not limited to the specific details, representative apparatus and methods, and illustrative examples shown and described. Therefore, departures may be made from such details without departing from the spirit or scope of the inventors general inventive concept.

What is claimed is:

1. An insulating cover for an electrical connector, the insulating cover comprising:

a walled structure defining a core chamber constructed and arranged to house an electrical connector having two conductor ports aligned in a row, a first opening which communicates with the core chamber, and a second opening which communicates with the core chamber, the core chamber constructed and arranged to house an electrical connector, each of the first and second openings constructed and arranged to allow an end portion of an electrical conductor to pass through the opening;

the insulating cover further having first and second hinged access covers respectively adjacent the first and second openings, the first and second hinged access covers constructed and arranged to selectively hingedly cover, and provide access to, the respective first and second openings and each access cover including a hinge normally biased to automatically close against the electrical conductor when the electrical conductor is passed through the corresponding one of the first and second openings;

the first chamber projecting outwardly from the core chamber and having an outer wall and both of the first and second openings, with the first and second openings and the first and second hinged access covers being aligned in a row, the first chamber further having an insulating divider wall positioned between the first and second openings and extending from the outer wall to the core chamber.

2. The insulating cover of claim 1 wherein the first hinged access cover includes a hinge having a first end and a second end, the first hinged access cover further including a first side edge adjacent the first end, a second side edge adjacent the second end, and an end opposite the hinge.

3. The insulating cover of claim 2 wherein the hinge has a first length, and the end opposite the hinge has an end edge having a second length, the second length of the end edge being substantially similar to the first length of the hinge.

4. The insulating cover of claim 3 wherein the first side edge has a third length and the second side edge has a fourth length, the third length of the first side edge being substantially similar to the fourth length of the second side edge.

5. The insulating cover of claim 2 wherein the first hinged access cover has a first section adjacent the hinge, and a second section adjacent the end opposite the hinge, the first and second sections being connected either directly or indirectly and having an interior angle of less than 180 degrees existing between them.

6. The insulating cover of claim 2 wherein the first hinged access cover has a first section adjacent the hinge, a second section adjacent the end opposite the hinge, and a third section positioned between the first section and the second section, a first interior angle of less than 180 degrees existing between the first and third sections, and a second interior angle of less than 180 degrees existing between the second and third sections to facilitate opening of the cover by a user and also to facilitate automatic closure of the cover against the electrical conductor.

7. The insulating cover of claim 6 wherein each of the first interior angle and the second interior angle independently has a value in the range of from 100 degrees to 150 degrees.

8. The insulating cover of claim 6 wherein each of the first interior angle and the second interior angle independently has a value in the range of from 120 degrees to 135 degrees.

9. The insulating cover of claim 2 wherein the hinge includes a living hinge.

10. The insulating cover of claim 1 in combination with an electrical connector, the electrical connector being housed in the core chamber of the insulating cover.

11. An insulating cover for an electrical connector, the insulating cover comprising:

a walled structure defining a core chamber, a first opening which communicates with the core chamber, and a second opening which communicates with the core chamber, the core chamber constructed and arranged to house an electrical connector, each of the first and second openings constructed and arranged to allow an end portion of an electrical conductor to pass through the opening; and the insulating cover further having a first hinged access cover adjacent one of the first and second openings, the first hinged access cover constructed and arranged to selectively hingedly cover, and provide access to, the one of the first and second openings and including a hinge normally biased to automatically close against the electrical conductor when the electrical conductor is passed through said one opening;

wherein the first hinged access cover is substantially circular in shape.

12. The insulating cover of claim 11 further including a second hinged access cover positioned on the first hinged access cover.

13. A insulating cover for an electrical connector, the insulating cover comprising:

a walled structure defining a core chamber, a first opening which communicates with the core chamber, and a second opening which communicates with the core chamber, the core chamber constructed and arranged to house an electrical connector, each of the first and second openings constructed and arranged to allow an end portion of an electrical conductor to pass through the opening;

the insulating cover further having a first hinged access cover adjacent one of the first and second openings, the first hinged access cover constructed and arranged to selectively hingedly cover, and provide access to, the one of the first and second openings and including a hinge normally biased to automatically close against the electrical conductor when the electrical conductor is passed through said one opening;

the insulating cover including a first chamber which projects outwardly from the core chamber and includes the first hinged access cover, the first chamber having one of the first and second openings;

the insulating cover further including a second chamber projecting outwardly from the core chamber, the second chamber having an opening which communicates with the core chamber; and wherein the second chamber is peripherally spaced approximately 90 degrees from the first chamber.

14. The insulating cover of claim 13 wherein the opening of the second chamber is constructed and arranged to receive a tool for tightening and loosening a securing member in a securing port of an electrical connector when an electrical connector is positioned within the core chamber of the insulating cover.

15. The insulating cover of claim 14 wherein the insulating cover includes a third chamber projecting outwardly from the core chamber, the third chamber having an opening which communicates with the core chamber, the opening constructed and arranged to allow an end portion of an electrical conductor to pass through the opening.

16. The insulating cover of claim 15 wherein the third chamber is peripherally spaced approximately 180 degrees from the first chamber.

17. The insulating cover of claim 13 wherein the insulating cover includes a third chamber projecting outwardly from the core chamber, the third chamber being peripherally spaced approximately 180 degrees from the first chamber and having an opening which communicates with the core chamber.

18. An insulating cover for an electrical connector, the insulating cover comprising:

a walled structure defining a core chamber constructed and arranged to house an electrical connector having two securing ports aligned in a row, a first opening which communicates with the core chamber, and a second opening which communicates with the core chamber, the core chamber constructed and arranged to house an electrical connector, each of the first and second openings constructed and arranged to allow an end portion of an electrical conductor to pass through the opening;

the insulating cover further having first and second hinged access covers respectively adjacent the first and second openings, the first and second hinged access covers constructed and arranged to selectively hingedly cover, and provide access to, the respective first and second openings and each access cover including a hinge normally biased to automatically close against the electrical conductor when the electrical conductor is passed through the corresponding one of the first and second openings;

the insulating cover including a first chamber projecting outwardly from the core chamber and having an outer wall and both of the first and second openings, with the first and second openings, and the first and second hinged access covers being aligned in a row, the first chamber further having an insulating divider wall positioned between the first and second openings and extending from the outer wall to the core chamber; and the insulating cover including a second chamber projecting outwardly from the core chamber, the second chamber having an outer wall and respective third and fourth openings aligned in a row and communicating with the core chamber, the second chamber further having a second insulating divider wall positioned between the third and fourth openings and extending from the outer wall to the core chamber, each of the third and fourth openings including respective third and fourth hinged access covers constructed and arranged to selectively hingedly cover, and provide access to, the third and fourth openings and including a hinge normally biased to automatically close against the electrical conductor when the electrical conductor is passed through said one opening.

19. The insulating cover of claim 18 wherein each one of the pair of openings is constructed and arranged to receive a tool for tightening and loosening a corresponding securing member in a corresponding securing port of an electrical connector when an electrical connector is positioned within the core chamber of the insulating cover.

20. An insulating cover for an electrical connector, the insulating cover comprising:

a walled structure defining a core chamber, a first opening which communicates with the core chamber, and a second opening which communicates with the core chamber, the core chamber constructed and arranged to house an electrical connector, each of the first and second openings constructed and arranged to allow an end portion of an electrical conductor to pass through the opening;

the insulating cover further having a first hinged access cover adjacent one of the first and second openings, the first hinged access cover constructed and arranged to selectively hingedly cover, and provide access to, the one of the first and second openings and including a hinge normally biased to automatically close against the electrical conductor when the electrical conductor is passed through said one opening; and the insulating cover including a first chamber which projects outwardly from the core chamber, the first chamber having one of the first and second openings, the core chamber being constructed and arranged to house an electrical connector having first and second securing ports aligned in a row, the insulating cover including a second chamber projecting outwardly from the core chamber, the second chamber having an outer wall and a pair of openings aligned in a row and communicating with the core chamber, the outer wall having an interior surface which includes a projection, the projection constructed and arranged whereby, when an electrical connector having first and second securing ports aligned in a row is housed in the core chamber, the projection prevents a securing member associated with one of the first and second securing ports from becoming associated with the other one of the first and second securing ports.

21. An insulating cover for an electrical connector, the insulating cover comprising:

a walled structure defining a core chamber, a first opening which communicates with the core chamber, and a second opening which communicates with the core chamber, the core chamber constructed and arranged to house an electrical connector, each of the first and second openings constructed and arranged to allow an end portion of an electrical conductor to pass through the opening;

a first hinged access cover adjacent one of the first and second openings, the first hinged access cover constructed and arranged to selectively hingedly cover, and provide access to, the one of the first and second openings and to close against a range of different electrical conductor sizes which may be passed through said openings;

a first chamber which projects outwardly from the core chamber, the first chamber having one of the first and second openings; and a second chamber projecting outwardly from the core chamber, the second chamber having an opening which communicates with the core chamber and which is constructed and arranged to receive a tool for tightening and loosening a securing member in a securing port of an electrical connector when the electrical connector is positioned within the core chamber of the insulating cover, the opening further constructed to retain said securing member within the second chamber should the securing member become disassociated from said securing port.

* * * * *